US008094862B2

(12) United States Patent
Funahashi

(10) Patent No.: US 8,094,862 B2
(45) Date of Patent: Jan. 10, 2012

(54) SPEAKER

(75) Inventor: Osamu Funahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 561 days.

(21) Appl. No.: 11/718,104

(22) PCT Filed: Nov. 30, 2006

(86) PCT No.: PCT/JP2006/323898

§ 371 (c)(1),
(2), (4) Date: Apr. 27, 2007

(87) PCT Pub. No.: WO2007/066561

PCT Pub. Date: Jun. 14, 2007

(65) Prior Publication Data

US 2009/0080685 A1 Mar. 26, 2009

(30) Foreign Application Priority Data

Dec. 7, 2005 (JP) ..... 2005-352998

(51) Int. Cl.
*H04R 25/00* (2006.01)

(52) U.S. Cl. ..... 381/398; 381/403; 381/404

(58) Field of Classification Search ..... 381/396, 381/398, 403, 404, 405, 423, 432, 433; 181/171, 181/172

See application file for complete search history.

(56) References Cited

U.S. PATENT DOCUMENTS

| | | | | |
|---|---|---|---|---|
| 6,236,733 | B1 * | 5/2001 | Kato et al. | 381/423 |
| 6,655,495 | B2 | 12/2003 | Kuze et al. | |
| 6,735,323 | B1 * | 5/2004 | Chang | 381/404 |
| 2003/0079936 | A1 | 5/2003 | Kuze et al. | |

FOREIGN PATENT DOCUMENTS

| | | | |
|---|---|---|---|
| JP | 50-18231 | U | 2/1975 |
| JP | 56-049188 | * | 11/1981 |
| JP | 62-109598 | U | 7/1987 |
| JP | 2-133097 | | 11/1990 |
| JP | 2003-199192 | | 7/2003 |
| JP | 2003-199192 | A | 7/2003 |

OTHER PUBLICATIONS

Supplemental European Search Report.

International Search Report (PCT/JP2006/323898) dated Feb. 6, 2007.

Japanese Office action for Appl. No. H2-133097, Nov. 5, 1990.

Chinese Office action dated Mar. 17, 2011.

European Search Report dated Jun. 16, 2011.

* cited by examiner

*Primary Examiner* — Huyen D Le

(74) *Attorney, Agent, or Firm* — Pearne & Gordon LLP

(57) ABSTRACT

A speaker having smaller distortion and driven at higher efficiency is disclosed. The speaker includes a frame, a magnetic circuit supported by the frame, a voice coil unit placed movable with respect to magnetic gap provided to the magnetic circuit, a diaphragm of which outer rim is coupled to the frame via a first edge, and of which inner rim is coupled to the voice coil unit, and a damper placed on the magnetic circuit side with respect to the diaphragm, and which damper has an outer rim coupled to the frame and an inner rim coupled to the voice coil unit. The outer rim of the damper is coupled to the frame via a second edge, which includes a first protrusion protruding toward the diaphragm and a second protrusion protruding oppositely to the first protrusion.

6 Claims, 4 Drawing Sheets

PRIOR ART

SPEAKER

TECHNICAL FIELD

The present invention relates to speakers

BACKGROUND ART

FIG. 4 shows a partial sectional view of a conventional speaker, which comprises the following elements:

- magnetic circuit 1A;
- voice coil unit 2A movably placed on magnetic circuit 1A;
- diaphragm 3A of which inner rim is coupled to voice coil unit 2A;
- edge 4A with which an outer rim of diaphragm 3A is coupled to frame 5A; and
- suspension holder 6A and edge 7A with both of which a rear face of diaphragm 3A is coupled to frame 5A.

Edge 4A and edge 7A protrude oppositely to each other, so that vertical excursion of diaphragm 3A becomes symmetric with respect to a horizontal axis in FIG. 4, thereby reducing distortion of the speaker.

Such a conventional speaker as discussed above is disclosed in, e.g. Unexamined Japanese Patent Publication No. 2004-7332 referred to as cited reference 1.

The foregoing conventional speaker, however, employs suspension holder 6A which firmly holds diaphragm 3A, so that the weight of the speaker excursion parts becomes heavy. The heavy weight does not matter to a woofer to which a large amount of output is applied, but it matters to a full-range and a mid-range speaker because the heavy excursion parts weight lowers the driving efficiency.

DISCLOSURE OF INVENTION

The present invention aims to provide a low-distortion speaker driven at higher efficiency. This speaker comprising the following elements in order to achieve the foregoing advantages:

- a frame;
- a magnetic circuit supported by the frame;
- a voice coil unit placed movably with respect to magnetic gap provided to the magnetic circuit;
- a diaphragm of which outer rim is coupled to the frame via a first edge, and of which inner rim is coupled to the voice coil unit; and
- a damper placed on the magnetic circuit side with respect to the diaphragm, i.e. nearer to the magnetic circuit than the diaphragm, and which damper has an outer rim coupled to the frame and an inner rim coupled to the voice coil unit.

The outer rim of the damper is coupled to the frame via a second edge, which includes a first protrusion protruding toward the diaphragm and a second protrusion protruding oppositely to the first protrusion.

The structure discussed above allows suppressing the distortion, and the lighter excursion parts weight of this structure invites an improvement in the driving efficiency.

DESCRIPTION OF REFERENCE MARKS

Figure 1:
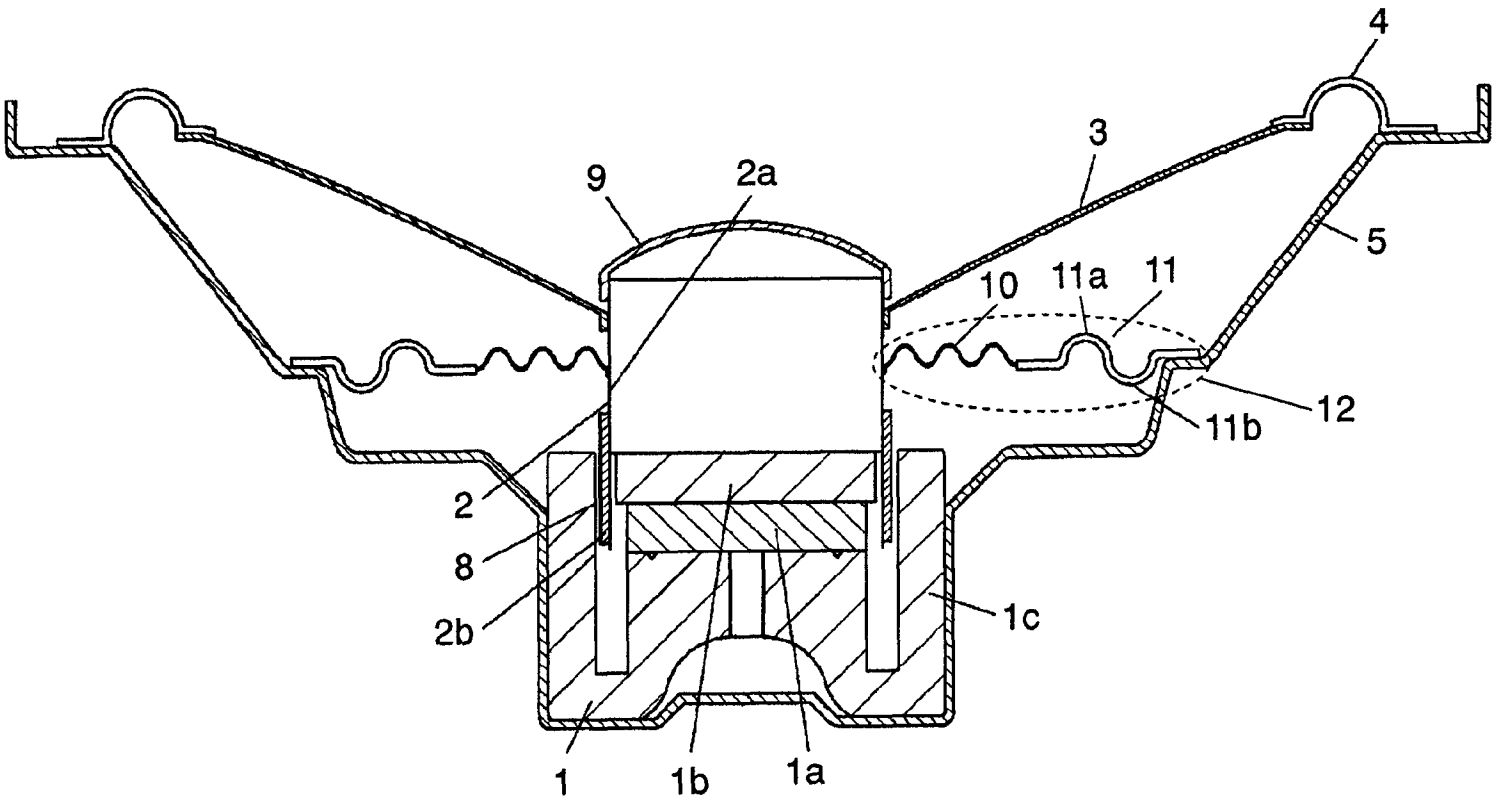
FIG. 1 shows a sectional view of a speaker in accordance with a first embodiment of the present invention.

1 magnetic circuit
2 voice coil unit
3 diaphragm
4 first edge
5 frame
8 magnetic gap
10 damper
11, 11*c* second edge
11*a*, 11*d* first protrusion
11*b*, 11*e* second protrusion

DETAILED DESCRIPTION OF PREFERRED EMBODIMENTS

Exemplary Embodiment 1

The first exemplary embodiment is demonstrated hereinafter with reference to the accompanying drawings. FIG. 1 shows a sectional view of a speaker in accordance with the first embodiment of the present invention.

Cone-shaped frame 5 includes magnetic circuit 1 at its bottom center, and magnetic circuit 1 is formed by combining and bonding disk-shaped magnet 1*a*, disk-shaped plate 1*b*, and cylindrical yoke 1*c* together. Inner wall of yoke 1*c* and outer wall of plate 1*b* form cylindrical magnetic gap 8 open upward with respect to magnetic circuit 1. Voice coil unit 2 is formed by winding coil 2*b* on cylindrical body 2*a*, and placed movably in the vertical direction along magnetic gap 8, thereby vibrating diaphragm 3 which shapes like a thin saucer and is coupled to the upper section of the outer wall of voice coil unit 2. Dust cap 9 is provided to the upper end of voice coil unit 2 in order to prevent dust from entering into the speaker.

Diaphragm 3 produces the sound of the speaker, so that it is made mainly from pulp and resin, both of which materials allow balancing high rigidity with internal loss. The outer rim of diaphragm 3 is coupled to an end of the opening of frame 5 via first edge 4 upwardly projected, and the inner rim thereof is fixed to voice coil unit 2. First edge 4 is made of urethane, expanded rubber, SBR rubber, or fabric so that it cannot apply moving load to diaphragm 3.

Figure 2:
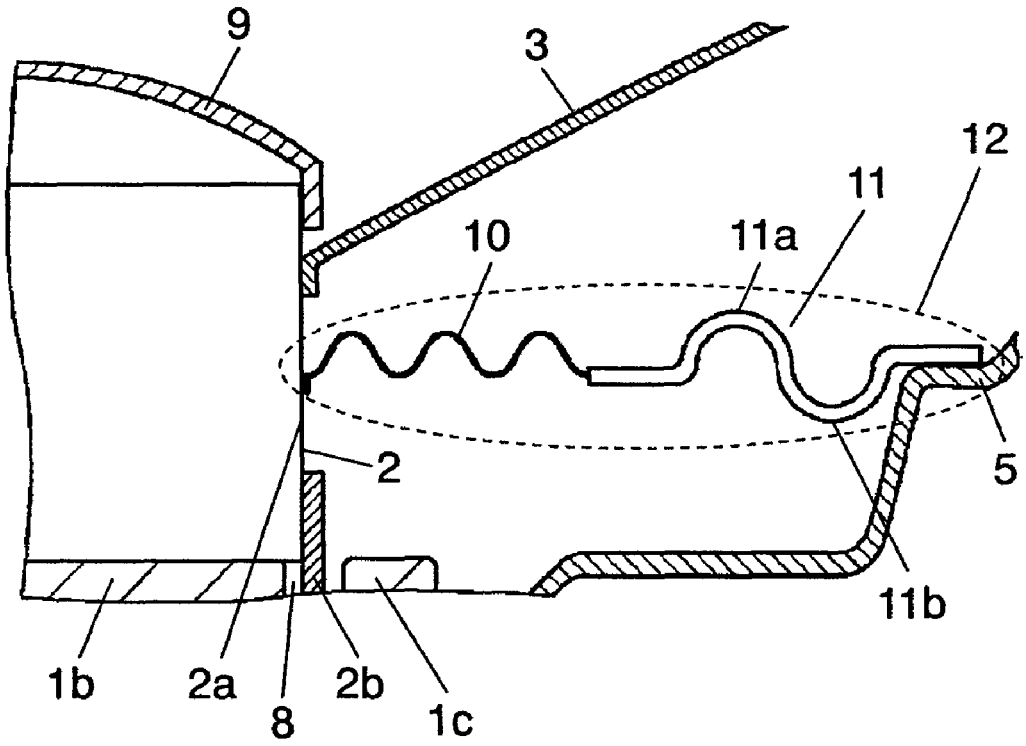
FIG. 2 shows an enlarged sectional view of an essential part of the speaker in accordance with the first embodiment of the present invention.

FIG. 2 shows an enlarged sectional view of an essential part of the speaker shown in FIG. 1. As shown in FIGS. 1 and 2, an inner rim of damper 10 is coupled to voice coil unit 2 at the lower side than the place where diaphragm 3 is fixed to voice coil unit 2, i.e. nearer to magnetic circuit 1 than diaphragm 3, and an outer rim of damper 10 is coupled to frame 5 via second edge 11 independent of damper 10 and frame 5. Damper 10 forms ring-shaped corrugation so that it can expand or shrink in response to the movement of voice coil unit 2. Similar to first edge 4, damper 10 is made of urethane, expanded rubber, SBR rubber, or fabric so that it cannot apply moving load to diaphragm 3.

An application of an audio signal to coil 2*b* of voice coil unit 2 prompts voice coil unit 2 to move up and down because voice coil unit 2 reacts to the magnetic field of magnetic gap 8. This movement vibrates diaphragm 3 for the speaker to produce the sound. Placement of second edge 11, in particular, at the outer rim of damper 10 allows suppressing the distortion of the speaker, and on top of that, it improves the driving efficiency of the speaker.

Damper 10 is originally supposed to be coupled between frame 5 and voice coil unit 2 at its inner rim and outer rim, so that it suppresses the rolling of voice coil unit 2 in moving. Damper 10 forms corrugation and has elasticity in order to easily follow the movement of voice coil unit 2. This corrugation shape allows applying moderate load to voice coil unit 2 in vibrating at small amplitude; however, the load increases at the greater amplitude of voice coil unit 2.

In this first embodiment, the outer rim of damper 10 is thus coupled to frame 5 via second edge 11. This structure allows voice coil unit 2 to move in a wider range, and when damper 10 becomes some load to voice coil unit 2, second edge 11 receives stress and then elastically deforms in response to the stress. When voice coil unit 2 moves in greater amplitude, damper 10 thus hardly interferes with this amplitude, so that the lowering of the driving efficiency can be suppressed.

In this embodiment, voice coil unit 2 is suspended along the vertical direction by two suspensions, namely, first edge 4 and a combination of damper 10 and second edge 11, and yet, first edge 4 is thinned to make itself lighter in order to increase the driving efficiency of diaphragm 3. The excursion parts weights of a combination of damper 10 and second edge 11, diaphragm 3 and first edge 4 are thus reduced.

A thinner first edge 4 will weaken the suspending strength to voice coil unit 2, so that second edge 11 employs a thicker edge to prevent voice coil unit 2 from being suspended with weaker strength. As a result, combination 12 formed of damper 10 and second edge 11 has a greater elasticity modulus (more rigid) than that of first edge 4.

The structure discussed above allows voice coil unit 2 to be suspended mainly by combination 12 of damper 10 and second edge 11, so that downward load and upward load of combination 12 are desirably as equal as possible in order to suppress the distortion in vertical movement of diaphragm 3.

This first embodiment thus employs the following structure: second edge 11 includes first protrusion 11*a* protruding toward diaphragm 3 and second protrusion 11*b* protruding oppositely to first protrusion 11*a*. To be more specific, damper 10 forms a corrugated ring-shape and is generally symmetric with respect to a horizontal axis in FIG. 2, so that the load of damper 10 per se is approx. symmetrical with respect to the horizontal axis.

To make the upward stiffness as equal as possible to the downward stiffness of combination 12 formed of damper 10 and second edge 11, it is necessary to make the upward stiffness as equal as possible to the downward stiffness of second edge 11.

This first embodiment thus employs the following structure as discussed above: Second edge 11 includes first protrusion 11*a* protruding toward diaphragm 3 and second protrusion 11*b* protruding oppositely to protrusion 11*a*. This structure allows the upward stiffness of combination 12 to be as equal as possible to the downward stiffness of combination 12. To be more specific, first protrusion 11*a* and second protrusion 11*b* protrude oppositely to each other so that upward excursion load hardly differs from downward excursion load.

As a result, the upward and downward excursion of diaphragm 3 becomes symmetrical, thereby reducing the distortion of the speaker, and yet, excursion parts become lightweighted, so that the speaker can work as a full-range or a mid-range speaker with high driving efficiency.

The foregoing structure, i.e. damper 10 is coupled to frame 5 via second edge 11, allows maintaining the linearity of power linearity due to the corrugated damper 10 until the movable range of voice coil unit 2 becomes somewhat large enough. When the movable range becomes greater than a given one and it becomes difficult to maintain the linearity, the elasticity of second edge 11 compensates the linearity, thus the elastic modulus of second edge 11 is desirably set greater (more rigid) than that of damper 10.

Damper 10 preferably has an elastic modulus different from that of second edge 11, and these two elements desirably work independently of each other in response to the movable range of voice coil unit 2. Between damper 10 and second edge 11, to be more specific, at the joint of damper 10 and second edge 11, an elastic modulus is set greater (more rigid) than those of damper 10 and second edge 11, thereby maintaining the independency of both the elements.

A greater elastic modulus (more rigid) at the joint of damper 10 and second edge 11 can be set this way for instance: second edge 11 and damper 10 are bonded together with hard adhesive such as acrylic-based adhesive, or second edge 11 and damper 10 are integrated by insert molding and then the joint is thickened, or reinforcing member is bonded to the joint.

Exemplary Embodiment 2

The second embodiment is demonstrated hereinafter with reference to the accompanying drawings. The second embodiment is similar to the first one in many points, so that the descriptions of similar points are omitted, and only different points are described hereinafter.

Figure 3:
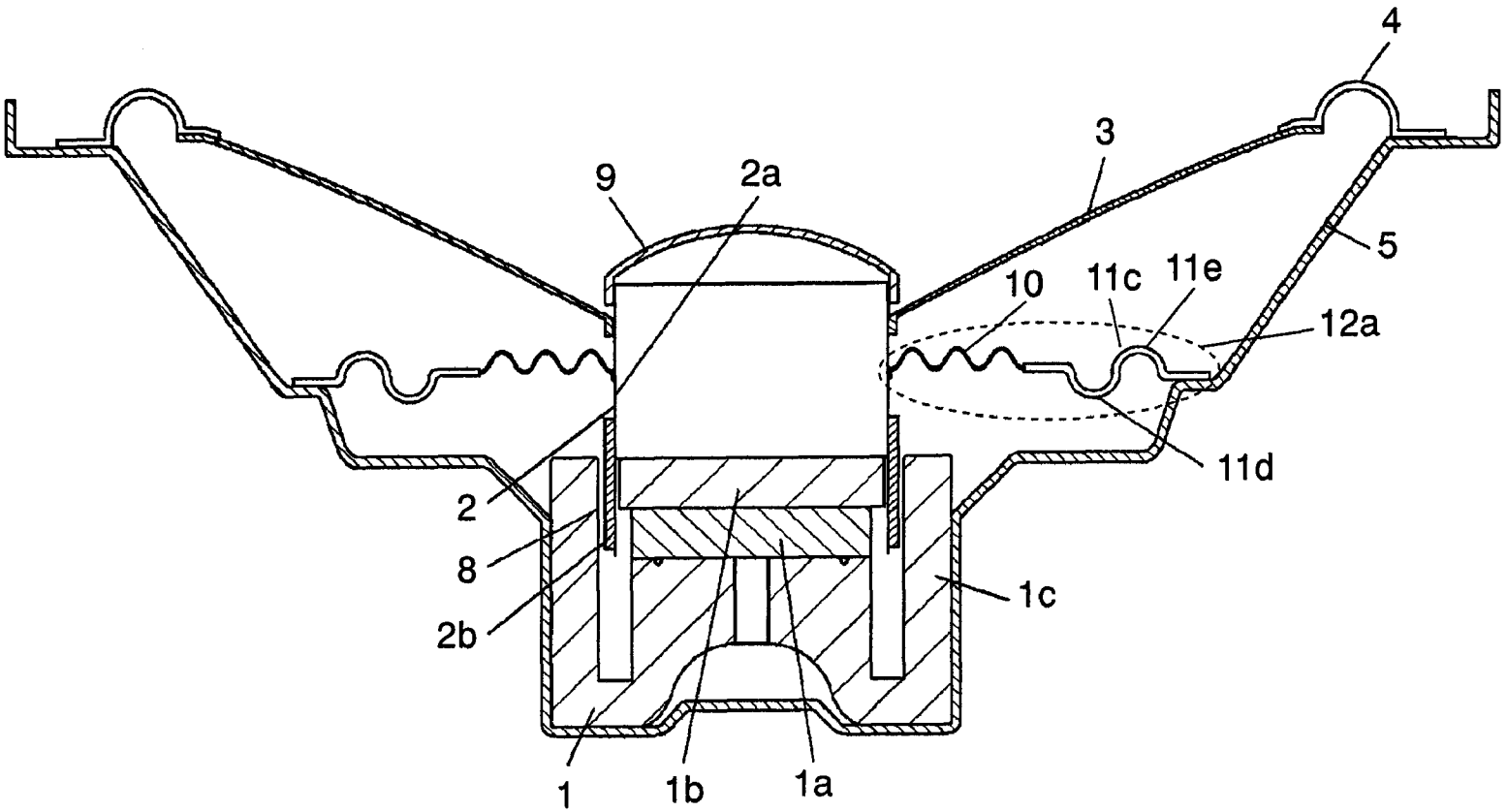
FIG. 3 shows a sectional view of a speaker in accordance with a second embodiment of the present invention.
Figure 4:
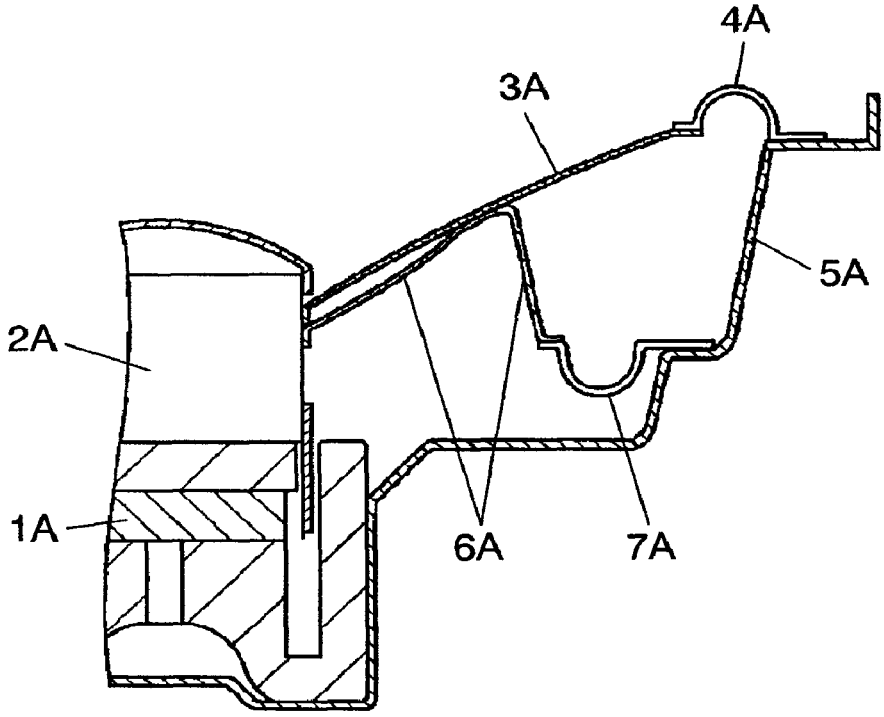
FIG. 4 shows a sectional view of a conventional speaker in part.

FIG. 3 shows a sectional view of a speaker in accordance with the second embodiment, in which second edge 11*c* changes its shape from what is shown in FIG. 2 and used in the first embodiment.

To be more specific, in the first embodiment shown in FIG. 2, first protrusion 11*a* located on more inner side of the speaker than second one protrudes toward diaphragm 3, and second protrusion 11*b* located on more outer side of the speaker than the first one protrudes opposite to the first one; however, the directions of the protrusions are not always limited to this instance. The second embodiment shown in FIG. 3 thus protrudes second protrusion 11*e* located on more outer side of the speaker than the first one toward diaphragm 3, and protrudes first protrusion 11*d* located on more inner side of the speaker than the second one toward the opposite direction.

The foregoing structure also allows making the upward stiffness to be as equal as possible to the downward stiffness of combination 12*a* formed of damper 10 and second edge 11*c*, so that upward excursion load hardly differs from downward excursion load.

INDUSTRIAL APPLICABILITY

The present invention can reduce the distortion of speaker, and improves the driving efficiency thereof as well, so that the present invention is useful particularly for full-range and mid-range speakers.

The invention claimed is:

1. A speaker comprising:

a frame;

a magnetic circuit supported by the frame;

a voice coil unit placed movably with respect to magnetic gap provided to the magnetic circuit:

a diaphragm of which outer rim is coupled to the frame via a first edge, and of which inner rim is coupled to the voice coil unit; and a damper placed on the magnetic circuit side with respect to the diaphragm, and having an outer rim is coupled to the frame and an inner rim coupled to the voice coil unit, wherein the outer rim of the damper is coupled to the frame via a second edge, which includes a first protrusion protruding toward the diaphragm and second protrusion protruding oppositely to the first protrusion, and wherein the second edge is stiffer than that of the damper, and, wherein a combination formed of the damper and the second edge is stiffer than that of the first edge.

2. The speaker of claim 1, wherein a joint of the damper and the second edge is stiffer than those of the damper and the second edge.

3. The speaker of claim 1, wherein a stiffness of the combination in a direction in which the first protrusion protrudes is equal to a stiffness of the combination in a direction in which the second protrusion protrudes.

4. A speaker comprising:

a frame;

a magnetic circuit supported by the frame;

a voice coil unit placed movably with respect to magnetic gap provided to the magnetic circuit;

a diaphragm of which outer rim is coupled to the frame via a first edge, and of which inner rim is coupled to the voice coil unit; and a damper placed on the magnetic circuit side with respect to the diaphragm, and having an outer rim coupled to the frame and an inner rim coupled to the voice coil unit, wherein the outer rim of the damper is coupled to the frame via a second edge, which includes at least one first protrusion protruding toward the diaphragm and at least one second protrusion protruding oppositely to the first protrusion, and wherein a total number of the at least one first protrusion equals a total number of the at least one second protrusion, and wherein the second edge is stiffer than that of the damper.

5. The speaker of claim 4, wherein the total number of the at least one first protrusion is one, and the total number of the at least one second protrusion is one.

6. A speaker comprising:

a frame;

a magnetic circuit supported by the frame;

a voice coil unit placed movably with respect to magnetic gap provided to the magnetic circuit;

a diaphragm of which outer rim is coupled to the frame via a first edge, and of which inner rim is coupled to the voice coil unit; and a damper placed on the magnetic circuit side with respect to the diaphragm, and having an outer rim is coupled to the frame and an inner rim coupled to the voice coil unit, wherein the outer rim of the damper is coupled to the frame via a second edge, which includes a first protrusion protruding toward the diaphragm and second protrusion protruding oppositely to the first protrusion, and wherein the second edge is stiffer than that of the damper, and, wherein a joint of the damper and the second edge is stiffer than those of the damper and the second edge.

* * * * *